US007052408B1

(12) United States Patent
Leonard

(10) Patent No.: US 7,052,408 B1
(45) Date of Patent: May 30, 2006

(54) MULTIPOCKET GOLF NET ASSEMBLY

(76) Inventor: Willie Burt Leonard, 5902 Royalton St., Houston, TX (US) 77040

( * ) Notice: Subject to any disclaimer, the term of this patent is extended or adjusted under 35 U.S.C. 154(b) by 0 days.

(21) Appl. No.: 11/055,273

(22) Filed: Feb. 10, 2005

Related U.S. Application Data

(60) Provisional application No. 60/550,290, filed on Mar. 5, 2004.

(51) Int. Cl.
*A63B 69/36* (2006.01)

(52) U.S. Cl. ..... 473/197; 273/400

(58) Field of Classification Search ..... 473/150–155, 473/168–170, 172, 457, 190–197, 476–478; 273/398–402, 350
See application file for complete search history.

(56) References Cited

U.S. PATENT DOCUMENTS

| | | | | |
|---|---|---|---|---|
| 1,430,280 | A * | 9/1922 | Bolton | 473/197 |
| 1,527,988 | A * | 3/1925 | McMurtrie | 273/400 |
| 1,545,772 | A * | 7/1925 | Jacobs | 473/190 |
| 1,719,240 | A * | 7/1929 | Scanlan | 473/190 |
| 1,923,152 | A * | 8/1933 | Kohn | 473/190 |
| 2,458,105 | A * | 1/1949 | Sell | 473/190 |
| 2,988,360 | A * | 6/1961 | Lambiotte | 273/396 |
| 4,326,717 | A * | 4/1982 | McClimon | 473/197 |
| 4,395,042 | A * | 7/1983 | Boswell | 473/195 |
| 4,750,744 | A * | 6/1988 | Michalec | 473/195 |
| 4,948,147 | A * | 8/1990 | Pallanca | 273/402 |
| 5,042,813 | A * | 8/1991 | Huang | 473/153 |
| 5,467,990 | A | 11/1995 | Kitzhaber | 473/164 |
| 5,569,094 | A | 10/1996 | Macaluso | 473/197 |
| 5,730,442 | A * | 3/1998 | Anderson | 273/400 |
| 5,976,023 | A | 11/1999 | Cho | 473/197 |
| 5,984,793 | A * | 11/1999 | Palombi | 473/195 |
| 5,989,130 | A | 11/1999 | Macaluso | 473/197 |
| 6,135,894 | A | 10/2000 | Cho | 473/197 |
| 6,210,288 | B1 | 4/2001 | Kim | 473/197 |
| 6,514,149 | B1 | 2/2003 | Yoon | 473/197 |
| 6,517,444 | B1 | 2/2003 | Yoon | 473/197 |
| 2002/0111234 | A1 * | 8/2002 | MacNichol | 473/446 |
| 2003/0125121 | A1 * | 7/2003 | Rhee | 473/195 |
| 2005/0134001 | A1 * | 6/2005 | Rowan | 273/401 |

FOREIGN PATENT DOCUMENTS

DE 3344955 A1 * 6/1985

* cited by examiner

*Primary Examiner*—Mark S. Graham
(74) *Attorney, Agent, or Firm*—Buskop Law Group, P.C.; Wendy Buskop

(57) ABSTRACT

The golf net assembly for adapting an existing golf net assembly to an improved practice net includes a non-collapsing light framework for providing a shape; fabric assembly with a center target sheath secured to the light framework, and flexible connectors fixedly attached to the non-collapsing light framework for engaging an existing golf practice frame and wherein the flexible connectors can accommodate a variety of existing golf practice frame sizes.

21 Claims, 2 Drawing Sheets

MULTIPOCKET GOLF NET ASSEMBLY

The present application claims priority to U.S. Provisional Patent Application Ser. No. 60/550,290 filed on Mar. 5, 2004 now abandoned entitled "Multipocket Golf Net Assembly".

FIELD

The present embodiments relate to a multi-pocket golf net assembly for tracking the flight of hit golf balls. The assembly also relates relate to kits for adapting an existing golf net assembly to an improved practice net.

BACKGROUND

Golf is popular sport and recreational past time. Every year, millions of golfers devote significant time and resources toward improving their golf swings, particularly full swings with woods and irons. While actually playing a round of golf on a golf course is, of course, the most pleasurable method to develop these skills, a round of golf can consume a significant amount of time and money.

In order to practice, most golfers utilize so-called driving ranges, where the golfer can repeatedly practice drive or tee shots from a driving station. Even though the driving range is less time consuming and costs less then playing a round, driving ranges suffer from the limitations of access and availability to many golfers.

Many solutions to this problem have been proposed. One solution has been the development of frame and net structures that can be used at or near the golfer's home. Such nets may include a circular or square frame forming a periphery to which is attached a mesh or net material. Such frames usually comprise a set of interlocking right-angle poles that, when fully assembled, form a rectangular shape across. A vertical screen or net is disposed onto the rectangular shape into which a golf ball may be driven. These frames and nets of the prior art are, however, usually fairly expensive and complex to assemble, particularly when assembled alone. In addition, there are usually an inadequate amount of pockets positioned to accurately track the flight of the hit golf balls. Also, the loss of even a single pole segment renders the entire net useless. Such nets further typically consume significant storage space when not in use.

Other frames comprise self-erecting flexible loops that can be folded upon themselves and are attached about their periphery to a net or mesh. Although easier to deploy, such frames likewise tend to consume significant space and are typically smaller when deployed and hence of lower utility. Thus, golf practice nets that expand to a larger target area are desired.

Other suggestions are disclosed in Yoon U.S. Pat. No. 6,517,444; Yoon U.S. Pat. No. 6,514,149; Kim U.S. Pat. No. 6,210,288; Cho U.S. Pat. No. 6,135,894; Macaluso U.S. Pat. No. 5,989,130; Cho U.S. Pat. No. 5,976,023; Macaluso U.S. Pat. No. 5,569,094; and Kitzhaber U.S. Pat. No. 5,467,990.

A need has existed to track practice swings of golfers by the type of flight of the golf balls. A need has existed for ascertaining whether a golf ball has been hit consisting too high and to the left, or too low and to the left, too high and to the center, too low and to the center, too high and to the right and so on. A need has existed for an assembly designed to track patterns of hitting of golf balls.

BRIEF DESCRIPTION OF THE DRAWINGS

In the detailed description of the embodiments presented below, reference is made to the accompanying drawings, in which.

The present embodiments are detailed below with reference to the listed Figures.

DETAILED DESCRIPTION OF THE EMBODIMENTS

Before explaining the present embodiments in detail, it is to be understood that the embodiments are not limited to the particular descriptions and that it can be practiced or carried out in various ways.

The golf net assembly includes a non-collapsing light framework and a fabric assembly secured to the light framework. Flexible connectors can be fixedly attached to the non collapsing light framework. The non-collapsing light framework can provide the shape for the assembly. The fabric assembly can be a collection of sheaths adapted to remove weight from the net assembly due to the presence of golf balls. The golf net assembly can accommodate a variety of existing golf practice frame sizes as a kit attachable to existing structures.

The golf net assembly can be designed to track practice swings of golfers by the type of flight of the golf balls. The assembly tracks the patterns of hit golf balls, as well.

The assembly can ascertain whether a golf ball is being hit consistently too high and to the left, too low and to the left, too high and to the center, too low and to the center, too high and to the right and so on.

Figure 1:
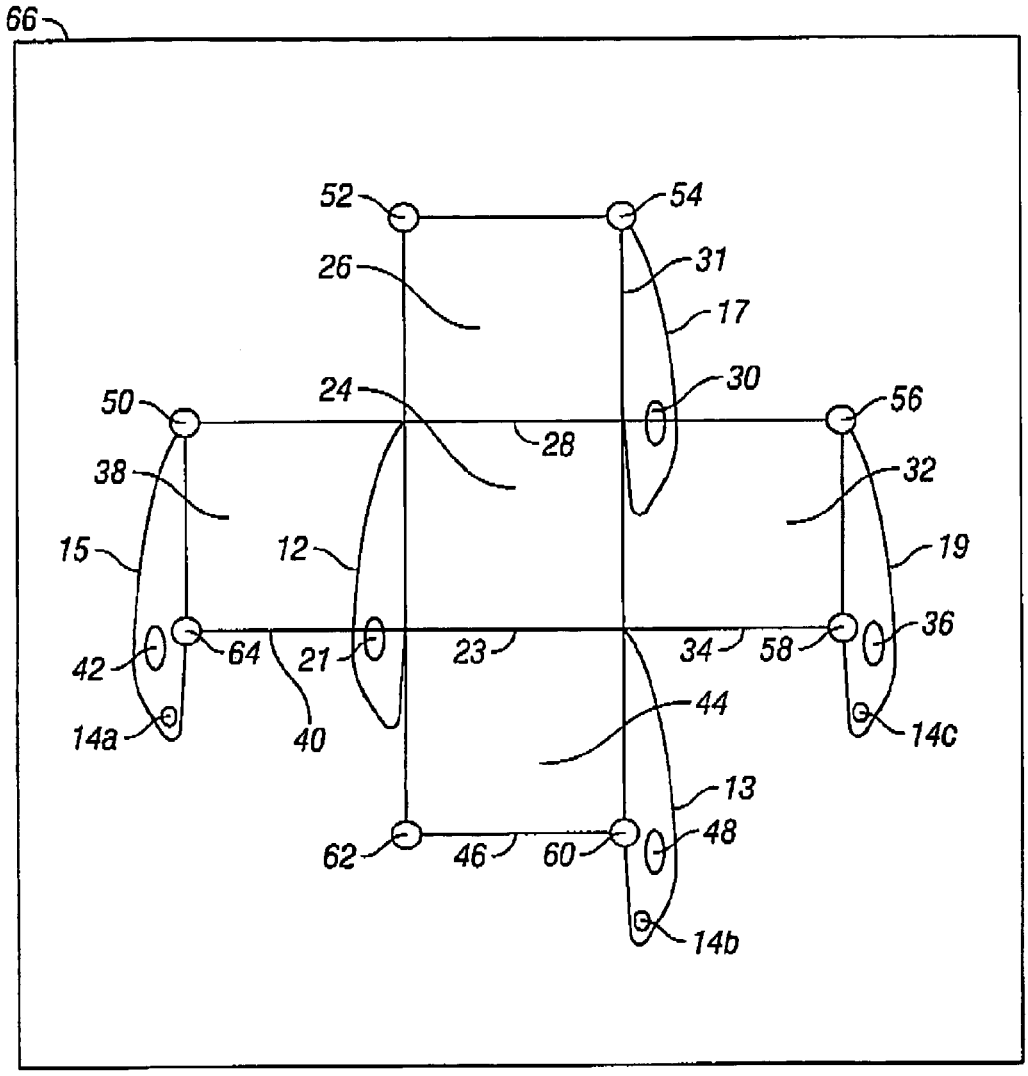
FIG. 1 depicts a front view of the golf net assembly for adapting an existing golf net assembly to an improved practice net.

With reference to the figures, FIG. 1 depicts a front view of the golf net assembly for adapting an existing golf net assembly to an improved practice net. The golf net assembly can be made of a framework (31), a fabric assembly attached to the back of the framework and flexible connectors (50, 52, 54, 56, 58, 60, 62, and 64).

The framework (31) can be a non-collapsing light framework (31) adapted to provide a shape for the fabric assembly. The framework (31) can be made of a durable material, such as stainless steel, steel, other durable metals, hard plastics or other suitable materials. The material can be used to maintain the shape of the framework when impacted by a golf ball.

The fabric assembly used in the golf net assembly can be secured to the framework (31). The fabric assembly can be secured to the light framework (31) using tape, tie-wraps, hooks, or other similar attachments. The fabric assembly can be formed in the shape of a tube secured to the light framework.

The fabric assembly can come in a range of sizes. The fabric assembly can have an overall width of from about 2 feet to about 10 feet and an overall height of from about 2 feet to about 10 feet. The fabric assembly can also be used for people with a height less of less than 48 inches.

The fabric assembly can be formed of fabric material that has openings that prevent the passage of a golf ball. The fabric material also permits the passage of wind and water. The fabric material can be a nylon mesh.

The fabric assembly can be made of a number of sheaths: a center target sheath (12), a first sheath (17), a second sheath (19), a third sheath (15), and a fourth sheath (13).

The center target sheath (12) can be located at the center of the fabric assembly behind the center target hole (24) and extent to the size of the target access hole (24). The target sheaths (12, 17, 19, 15, and 13) can be for collecting golf balls (14*a*, 14*b*, and 14*c*) and extent behind the respective center target hole (12), first target hole (26), second target hole (32), third target hole (38), and fourth target hole (44).

Figure 3:
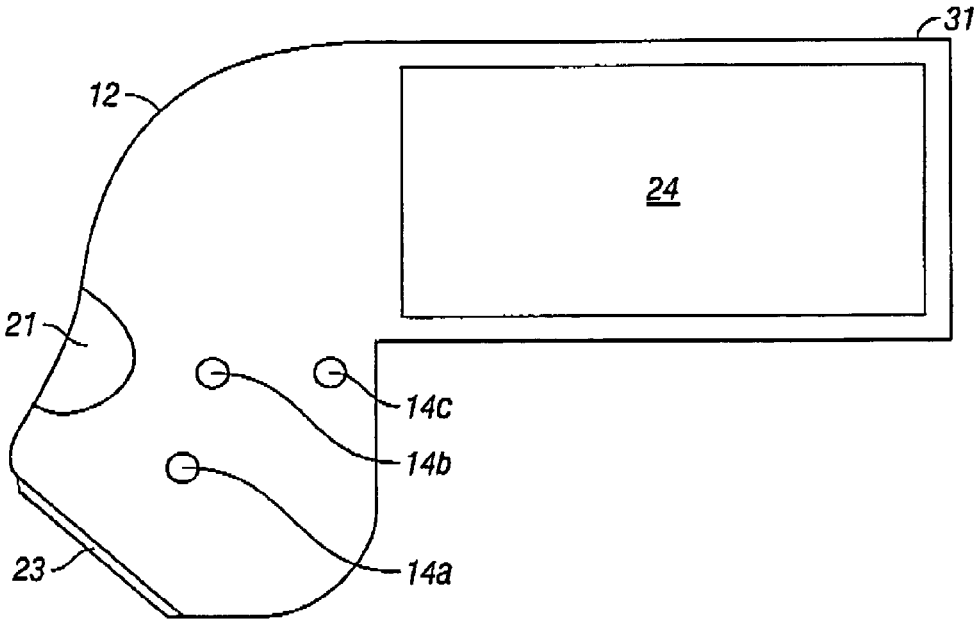
FIG. 3 depicts an isolated perspective view of the front target sheath.

The opening of the target holes (24) can have a range of dimensions. The dimensions can be 30 inches by 30 inches when the fabric assembly has a width of 8 feet and a height of 8 feet. The target access hole (24) can be a variety of shapes including a square, a rectangular, and a circular. FIG. 3 depicts the embodiment of a rectangular shape for the target access hole (24).

Returning to FIG. 1, the center target hole (24) has a center closed end (23) and a center access hole (21). The first target hole (26) has a first closed end (28) and a first access hole (30). The first target hole (26) can be adjacent to the top of the center target hole (12). The second target hole (32) has a second closed end (34) and a second access hole (36). The second target hole (32) can be located adjacent to the right of the center target hole (12). The third target hole (38) has a third closed end (40) and a third access hole (42) disposed adjacent to the left of the center target hole (12). The fourth target hole (44) has a fourth closed end (46) and a fourth access hole (48). The fourth target hole (44) can be located adjacent the bottom of the center target hole (12).

The target sheaths (12, 17, 19, 15, and 13) stop the flight of the golf ball. Once the flight of the golf ball is stopped gravity pulls the golf ball towards the closed end of the respective target hole. The closed end of the target hole directs the golf ball towards the area of the sheath hanging on to the side of a target hole. All of the golf balls hit in to a single target hole will be collected in the hanging area of the sheath where the access holes (21, 30, 36, 42, 48) can be used to remove the golf balls.

The sheaths are adapted to remove weight from the net assembly due to the presence of golf balls. The sheaths can be made of UV resistant materials, water resistant materials, polymer woven materials, or combinations of these materials. The sheath material needs to be durable enough to withstand the impact of a golf ball and to withstand being in an outside setting. The sheaths can be of a length sufficient to contain up to 100 golf balls without providing weight into the fabric assembly.

Returning to FIG. 1, the golf net assembly includes one or more flexible connectors (50, 52, 54, 56, 58, 60, 62, and 64). The flexible connectors are fixedly attached to the non-collapsing light framework (31). The connectors are adapted to engage an existing golf practice frame (66). The flexible connectors can accommodate a variety of existing golf practice frame sizes. The connectors can be rope for tying the fabric assembly to the existing golf practice frame or to two poles, or to the frame itself.

Types of rope usable are sisal, hemp, and combinations of polymer and organic rope material. From about eight to about one hundred connectors can be used to secure the fabric assembly over an existing golf practice frame.

An embodiment can be a kit using multi-pocket golf net assembly using the described herein.

Figure 2:
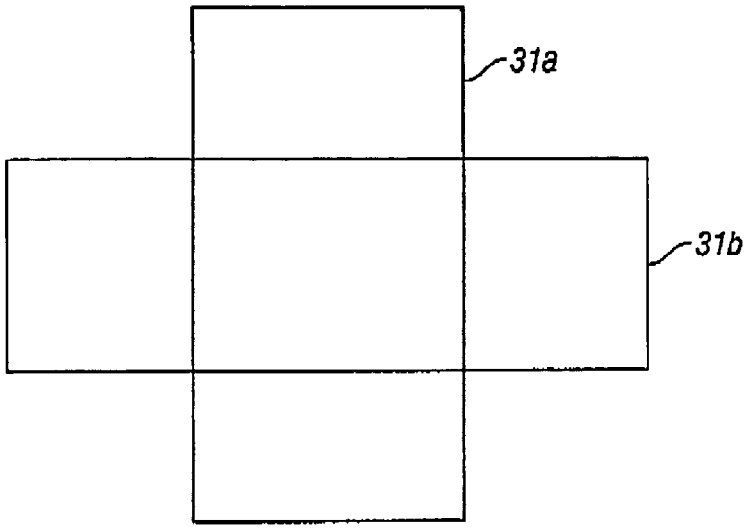
FIG. 2 depicts an isolated front view of the framework as two rectangular metal shapes.

FIG. 2 depicts a framework comprised of two rectangular metal shapes (31*a* and 31*b*) bonded together. The two rectangular metal shapes can be a tubular frame or other suitable material for making a frame, with an opening located where the two rectangular metal shapes over lap, the over lapping area can be where the target access hole (24) shown in FIG. 1 is located. The two rectangular metal shapes can be bonded together by welding, by use of an adhesive, or other similar method that can keep the shapes bonded together when impacted by a golf ball. As a size example of the framework, the rectangles (31*a* and 31*b*) can have a short side from about 2 feet to about 10 feet and a long side that can be at least 20% longer than the short side.

FIG. 3 depicts a center target hole (24) with the center target sheath (12) stretched behind the center target hole (24) and extending to the side of the center target hole (24) to form a catching area. The catching area contains the golf balls (14*a*, 14*b*, 14*c*) that travel through the center target hole (24). The golf balls (14*a*, 14*b*, 14*c*) can be removed from the catching area of the center target sheath (12) through the center access hole (21).

The golf net assembly can be designed as a stand alone game for accurate golf swinging. As a game, the rules of the game can have one player alone keeping score on where the balls hit the net, or two players can bet against each other, forming a gaming device using golf balls and golf clubs on where the balls can fly and how many in a defined time limit.

The golf net assembly can be used as an educational device for teaching children how to swing accurately at a target using a golf club and golf balls, the golf net assembly can show where on the net the golf balls are being hit by collecting the balls in a sheath corresponding to a target hole.

The embodiments have been described in detail with particular reference to certain embodiments thereof, but it will be understood that variations and modifications can be effected within the scope of the embodiments, especially to those skilled in the art.

What is claimed is:

1. A golf net assembly adapted to track the flight of golf balls comprising:

a. a non-collapsing light framework for providing a shape;

b. fabric assembly secured to the light framework, wherein the fabric assembly comprises:

i. a center target sheath for collecting golf balls comprising a top, a right, a left, and a bottom with a target closed end, and a target access hole;

ii. a first sheath with a first closed end and an first access hole, wherein the first sheath is adjacent to the top of the center target sheath;

iii. a second sheath with a second closed end and a second access hole disposed adjacent to the right of the center target sheath;

iv. a third sheath with a third closed end and a third access hole disposed adjacent to the left of the center target sheath; and v. a fourth sheath with a fourth closed end and a fourth access hole disposed adjacent the bottom side of the center target sheath; and wherein the sheaths are adapted to remove weight from the net assembly due to the presence of golf balls; and c. a plurality of flexible connectors fixedly attached to the framework for engaging an existing golf practice frame, and wherein the flexible connectors accommodate a variety of existing golf practice frame sizes.

2. The golf net assembly of claim 1, wherein the non collapsing light framework is a stainless steel, a steel or other metal that holds it shape if impacted by a golf ball.

3. The golf net assembly of claim 1, wherein the non collapsing light framework comprises two rectangular metal shapes bonded together.

4. The golf net assembly of claim 3, wherein the bonding is by welding or by use of an adhesive.

5. The golf net assembly of claim 3, wherein a first rectangle comprises a short side from 2 feet to 10 feet and a long side is at least 20% longer than the short side.

6. The golf net assembly of claim 1, wherein from 8 connectors to 100 connectors are used to secure the fabric assembly over an existing golf practice frame.

7. The golf net assembly of claim 1, wherein the connectors are rope for tying the fabric assembly to the existing golf practice frame.

8. The golf net assembly of claim 7, wherein the rope is sisal, hemp, or combinations of polymer and organic rope material.

9. The golf net assembly of claim 1, wherein the fabric assembly comprises an overall width of from 2 feet to 10 feet and an overall height of from 2 feet to 10 feet.

10. The golf net assembly of claim 9, wherein the fabric assembly is designed for use with people comprising a height less than 48 inches.

11. The golf net assembly of claim 1, wherein the center target sheath comprises an opening dimension of 30 inches by 30 inches and the fabric assembly comprises a width of 8 feet and a height of 8 feet.

12. The golf net assembly of claim 1, wherein the sheaths are made from UV resistant netting, water resistant netting, polymer woven netting, or combination thereof netting.

13. The golf net assembly of claim 12, wherein the polymer netting is nylon mesh.

14. The golf net assembly of claim 1, wherein the fabric assembly is formed from polymer netting comprising openings that prevents passage of golf ball.

15. The golf net assembly of claim 1, wherein the fabric material permits the passage of wind and water without passing golf balls.

16. The golf net assembly of claim 1, wherein each sheath comprises a length sufficient to contain up to 100 golf balls without providing weight into the fabric assembly.

17. The golf net assembly of claim 1, wherein the first sheath is above the center target sheath, the second sheath is right of the center target sheath, the third sheath is left of the center target sheath, and the fourth sheath is below the center target sheath.

18. The golf net assembly of claim 1, wherein the center target sheath opening is a shape selected from the group consisting of square, rectangular, and circular.

19. The golf net assembly of claim 1, wherein the sheaths are netting formed in the shape of a tube secured to the light framework.

20. The golf net assembly of claim 1, wherein each sheath is secured to the light framework with tape.

21. A kit comprising the golf net assembly of claim 1 attachable to an existing golf net frame.

* * * * *